US010330118B2

(12) United States Patent
Zhu et al.

(10) Patent No.: US 10,330,118 B2
(45) Date of Patent: Jun. 25, 2019

(54) FAN UNIT, AND ASSEMBLING AND REMOVING METHOD THEREOF

(71) Applicants: Inventec (Pudong) Technology Corporation, Shanghai (CN); INVENTEC CORPORATION, Taipei (TW)

(72) Inventors: Hui Zhu, Shanghai (CN); Jia-Bin Wang, Shanghai (CN)

(73) Assignees: INVENTEC (PUDONG) TECHNOLOGY CORPORATION, Shanghai (CN); INVENTEC CORPORATION, Taipei (TW)

( * ) Notice: Subject to any disclaimer, the term of this patent is extended or adjusted under 35 U.S.C. 154(b) by 419 days.

(21) Appl. No.: 15/057,629

(22) Filed: Mar. 1, 2016

(65) Prior Publication Data

US 2017/0146028 A1 May 25, 2017

(30) Foreign Application Priority Data

Nov. 24, 2015 (CN) ..... 2015 1 0827501

(51) Int. Cl.

| | |
|---|---|
| ***F04D 29/60*** | (2006.01) |
| ***F04D 29/58*** | (2006.01) |
| ***F04D 29/52*** | (2006.01) |
| ***F04D 29/64*** | (2006.01) |

(52) U.S. Cl.

CPC ..... *F04D 29/601* (2013.01); *F04D 29/522* (2013.01); *F04D 29/584* (2013.01); *F04D 29/646* (2013.01)

(58) Field of Classification Search

CPC .... F04D 29/646; F04D 29/601; F04D 29/584; F04D 29/522; H05K 7/1487; H05K 7/20172; H05K 7/20581

See application file for complete search history.

(56) References Cited

U.S. PATENT DOCUMENTS

| | | | | |
|---|---|---|---|---|
| 6,040,981 A * | 3/2000 | Schmitt | ..... | G06F 1/18 312/221 |
| 6,592,327 B2 * | 7/2003 | Chen | ..... | F04D 25/166 415/213.1 |
| 7,009,841 B2 * | 3/2006 | Chen | ..... | H05K 7/20172 165/80.3 |
| 7,054,155 B1 * | 5/2006 | Mease | ..... | H05K 7/20581 165/104.34 |

(Continued)

*Primary Examiner* — Patrick Hamo

(74) *Attorney, Agent, or Firm* — Muncy, Geissler, Olds & Lowe, P.C.

(57) ABSTRACT

The invention relates to a method for assembling a fan unit into an electronic device and removing therefrom. The electronic device has a first connector. The fan unit includes a fixture, a fan, a second connector and a handle. The fan is assembled into the fixture and electrically connected to the second connector. The handle is pivotally connected to the fixture and operable to be pivotally moved between a first position and a second position of the fixture. When the handle is operated to move to the first position, the fixture is pushed to approach to the first connector, so as to so as make the second connector connect to the first connector in mechanical and electrical. When the handle is operated to move to the second position, the fixture is pulled out by the handle, so as to make the second connector disconnected to the first connector.

8 Claims, 10 Drawing Sheets

(56) References Cited

U.S. PATENT DOCUMENTS

| | | | | |
|---|---|---|---|---|
| 9,888,605 | B2 * | 2/2018 | Xu | H05K 7/1457 |
| 2005/0036287 | A2 * | 2/2005 | Kosugi | F04D 19/007 361/695 |
| 2008/0239665 | A1 * | 10/2008 | Franz | F04D 29/646 361/695 |
| 2008/0253886 | A1 * | 10/2008 | Chen | F04D 29/601 415/213.1 |
| 2015/0351280 | A1 * | 12/2015 | Gonzalez Inda | H05K 7/20172 361/695 |

* cited by examiner

FAN UNIT, AND ASSEMBLING AND REMOVING METHOD THEREOF

BACKGROUND OF INVENTION

1. Field of the Invention

The present invention relates to a fan unit adapt for an electronic device and assembling and removing method thereof.

2. Description of the Prior Art

In general, the electronic device, such as a server, is usually configured with a fan module for heat dissipation, and then the heat generated from the internal circuit components of the electronic device in actual operation is dissipated through airflow produced by the fan module. Through this means, it is able to prevent the internal circuit elements of the electronic device from damage caused by overheating. However, the current fan module is designed with the function of Hot-Plug to avoid interrupting operation of the electronic device when replacing the fan module.

Currently, the fan module generally includes a fan bracket, and at least one fan unit with hot-plug function is disposed in the interior of the fan bracket. The fan unit is latched in the fan bracket through the upper and lower elastic members disposed in side of fan unit. However, the above design of the fan unit can't be assembled, removed, and maintained quickly.

SUMMARY OF THE INVENTION

One aspect of the invention is to provide a fan unit adapted for an electronic device, and assembling and removing method thereof to solve the problems described above.

In order to solve the problems of prior art, the present invention provides a fan unit adapted for an electronic device, the electronic device has a first connector. The fan unit includes a fixture, a fan, and a second connector. The fan is fixed in the fixture, the second connector is electrically connected to the fan; and the handle is pivotally connected to fixture. The handle is operable to be pivotally moved between a first position and a second position opposite to the fixture. When the handle is operated to move to the first position, the fixture is pushed to approach to the first connector by the handle, so as to make the second connector connect to the first connector in mechanical and electrical. When the handle is operated to move to the second position, the fixture is pulled out by the handle, so as to make the second connector disconnect to the first connector in mechanical and electrical.

According to an embodiment of the present invention, wherein a through hole is formed on the fixture, a flexible bolt is configured in the handle, when the handle is operated to move to the first position, the flexible bolt is inserted into the through hole and fixed with the electronic device.

According to an embodiment of the present invention, wherein a restriction structure is formed on the fixture, the handle is restricted in the second position when moves to the restriction structure pivotally.

According to an embodiment of the present invention, wherein the restriction structure is a cutout, and the cutout is configured on a bending line of the fixture.

According to an embodiment of the present invention, the fan unit further includes a connector bracket connected to the fixture for fixing the second connector detachably. A first avoidance space is formed in the connector bracket for accommodating a first wire coupled between the second connector and the fan.

According to an embodiment of the present invention, wherein the fan unit further comprising: a fan indicator light, disposed in front of the fan unit and electrically connected to the fan; wherein, a second avoidance space is formed in a front portion of the fixture for accommodating a second wire coupled between the fan indicator light and the fan.

According to an embodiment of the present invention, wherein the fixture is configured with a guiding structure formed in a horn shape groove for making the fan unit move along a guiding direction.

According to an embodiment of the present invention, wherein the handle comprising: a operating portion; and a pivoting portion, bent from two ends of the operating portion; wherein, the operating portion is forced to drive the pivoting portion move opposite the fixture pivotally.

In addition, the present invention further provides a method for assembling a fan unit, adapted for assembling the foregoing fan unit into a electronic device, the electronic device includes a first connector and a accommodating space. The accommodating space is applied to accommodate the fan unit. The method for assembling the fan unit includes steps of: (a) disposing the fan unit into the accommodating space, and make the handle dispose in the second position; (b) pushing the fan unit through the handle to make the second connector connect to the first connector; and (c) moving the handle to the first position pivotally, so as to make the second connector connect to the first connector in mechanical and electrical.

Furthermore, the present invention further provides a method for removing a fan unit assembled into electronic device by the foregoing assembling method, wherein the method for removing the fan unit includes steps of: (d) moving the handle from the first position to the second position pivotally; (e) pulling the fan unit through the handle, so as to make the second connector disconnect to the first connector in mechanical and electrical; and (f) taking out the fan unit from the accommodating space.

Compared to the prior art, according to the technique related to the structure, the assembling method and the removing method of the fan unit disclosed in the present invention, it can be known that the technique of the present invention can perform the following beneficial effects. The fan unit of the present invention can assemble the fan unit in the electronic device quickly through the handle connected to the fixture. Thus, the fan assembling process becomes easy, convenience, and quick. Simultaneously, when the fan unit of the present invention needs to be removed, the handle can be operated to move pivotally to remove the fan unit form the electronic device quickly, and the removing process is simple, and can be operated conveniently.

The fan unit of the present invention can achieve the pivotal position of the handle to be operated conveniently through the engaging connection between the through hole of the fixture and the flexible bolt of the handle. When the handle is located in the first position, the flexible bolt is fixed with the electronic device directly, thus the fan unit can be assembled into the electronic device independently without assembling the fan bracket. Therefore, when the fan needs to be replaced, it is unnecessary to remove the fan bracket, so as to make the removing process of the fan become easier. Simultaneously, the manufacturing cost of the electronic device can be reduced.

An cutout restricted the handle in the second position is formed on the bending line of the fixture in the present invention. Compare to the means of applying a protruding structure for stopping in prior art, the structure of the present invention is more simple, and the manufacturing cost is less.

The fixture of the present invention is configured with the guiding structure which is applied to guide the fan unit move along the guiding direction. The design of the guiding structure makes the fan unit be assembled fast and accurately. The second avoidance space accommodated the second wire coupled between the fan indicator light and the fan is formed in a front portion of the fixture of the present invention. This design can expand the assembling space of the second wire to make the fan indicator light be assembled smoothly.

DESCRIPTION OF THE PREFERRED EMBODIMENT

The invention disclosed herein is directed to a historical work parameter. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
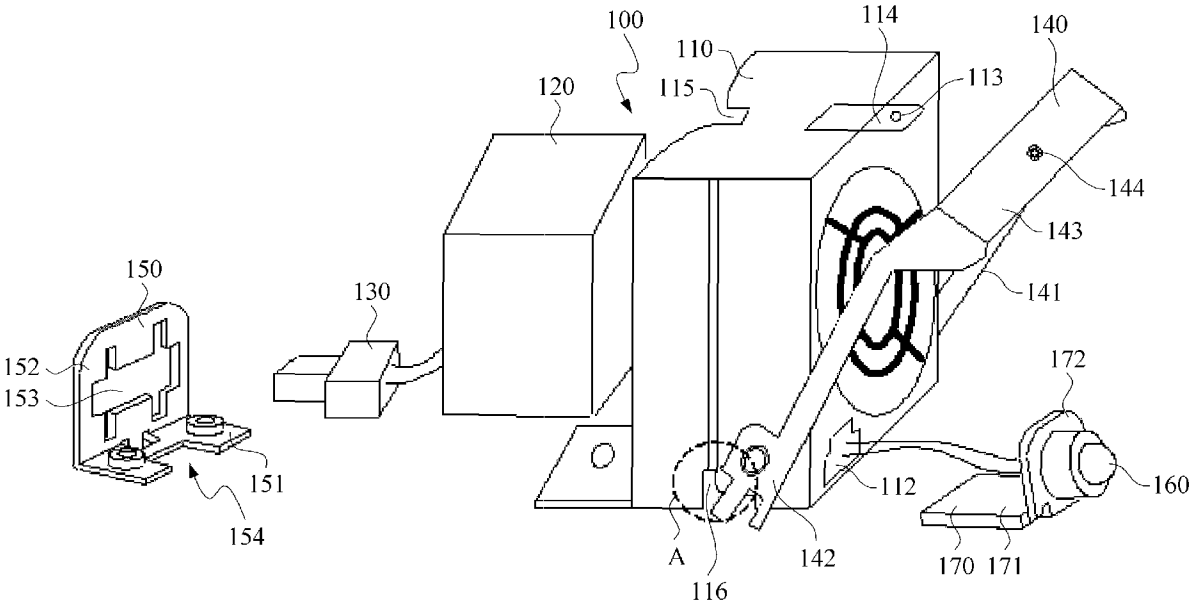
FIG. 1 is an exploded view illustrating the fan unit according to one preferred embodiment of the present invention.
Figure 2A:
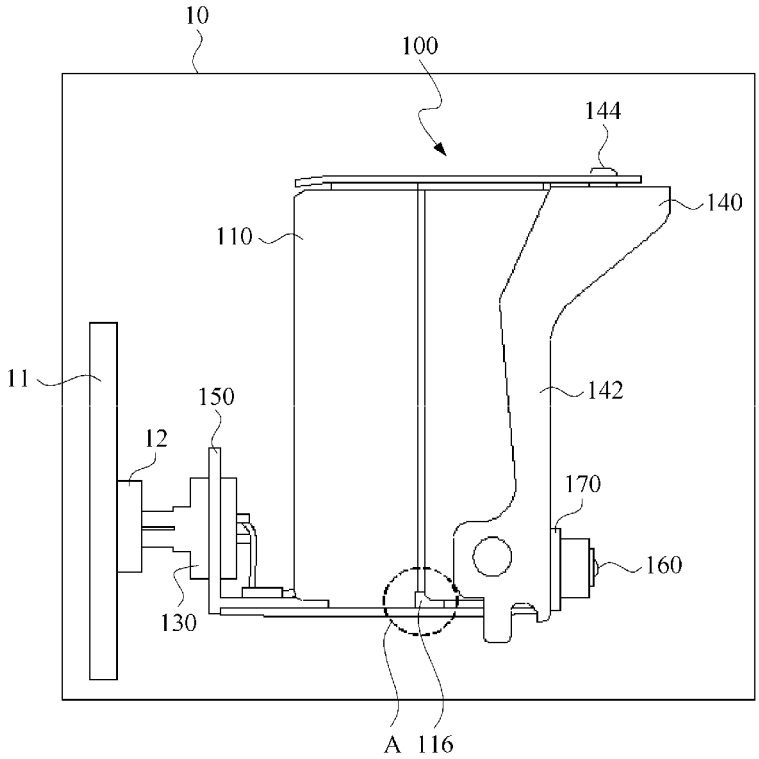
FIG. 2A is a side view illustrating the fan unit being assembled and located in a first position depicted in FIG. 1.
Figure 2B:
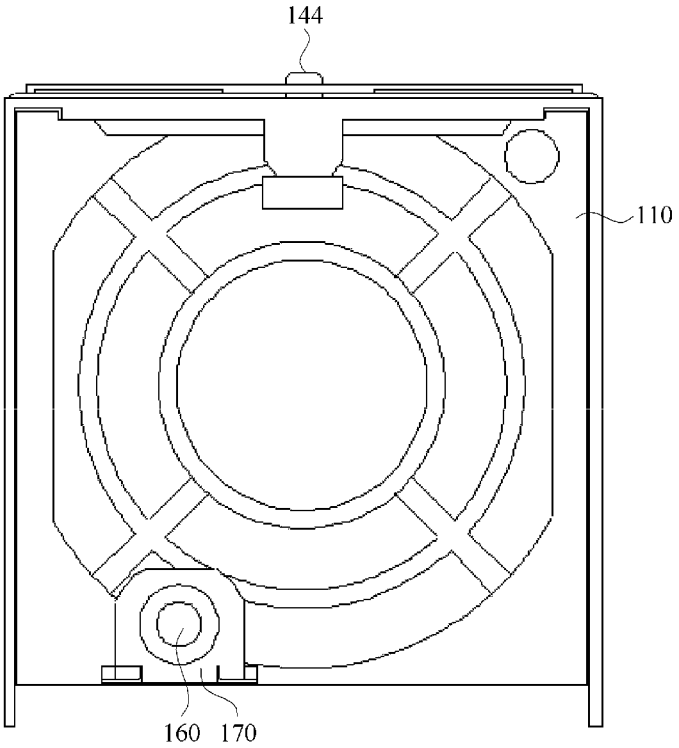
FIG. 2B is a front view illustrating the fan unit being assembled and located in a first position depicted in FIG. 1.
Figure 2C:
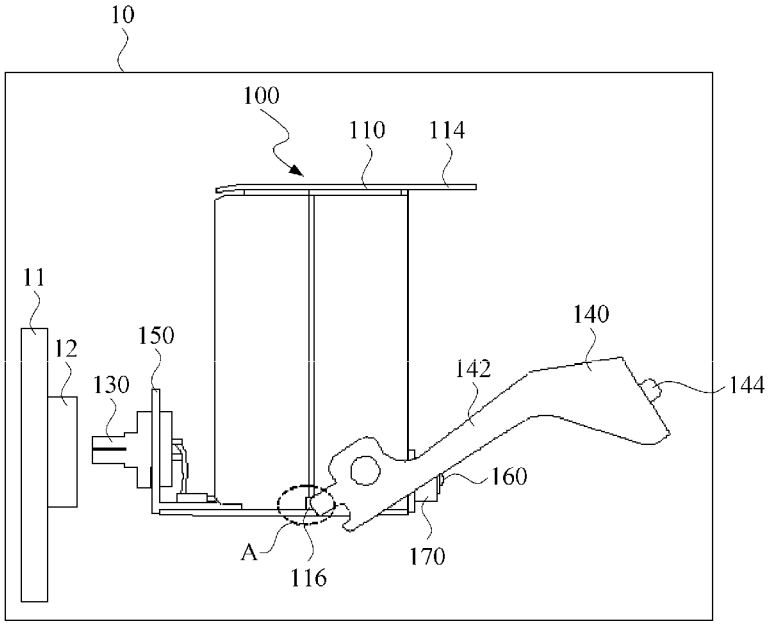
FIG. 2C is a side view illustrating the fan unit being assembled and located in a second position depicted in FIG. 1.

FIG. 1 is an exploded view illustrating the fan unit according to one preferred embodiment of the present invention. FIG. 2A is a side view illustrating the fan unit being assembled and located in a first position depicted in FIG. 1. FIG. 2B is a front view illustrating the fan unit being assembled and located in a first position depicted in FIG. 1. FIG. 2C is a side view illustrating the fan unit being assembled and located in a second position depicted in FIG. 1.

Referring to FIG. 1, FIG. 2A, FIG. 2B, and FIG. 2C, a fan unit 100 is adapted for an electronic device 10, such as a server. The electronic device 10 includes a circuit board 11 and a first connector 12 disposed on the circuit board 11. The fan unit 100 includes a fixture 110, a fan 120, a second connector 130, and a handle 140. The fan 120 is pivoted to the fixture 110, and the second connector 130 is electrically connected to fan 120.

The handle 140 is pivoted to the fixture 110, and the handle 140 is operable to be pivotally moved between a first position (as shown in FIG. 2A and FIG. 2B) and a second position (as shown in FIG. 2C) opposite to the fixture 110. Specifically, when the first connector 12 and the second connector 130 are connected by a user, a handle 140 can be pivotally moved to the position as shown in FIG. 2A and FIG. 2B opposite to fixture 110. At this moment, the second connector 130 can be pushed toward the first connector 12 through the fixture 110 by the handle 140 until the second connector 130 is completely plugged to the first connector 12 and electrically connected to the first connector 12. When the handle 140 is pivotally moved to the position as shown in FIG. 2B by the user, the fixture 110 is pulled outwardly by the handle 140 to make the fixture 110 gradually away from the first connector 12. This operation also makes the second connector 130 disconnect to first connector 12 and interrupt electrical connection. Therefore, the user can remove the connection between the first connector 12 and the second connector 130 conveniently and quickly.

When the handle 140 is located in the first position, the handle 140 can reinforce the restriction between the first connector 12 and the second connector 130, and prevents the disconnection between the first connector 12 and the second connector 130 caused by the vibration of fan 120 or other external forces. Thus, it is able to ensure that the fan unit 100 can be operated normally. In addition, when the handle 140 is located in second position, the second connector 130 can be pulled out from the first connector 12 by the user through handle 140.

In one preferred embodiment of the present invention, the fan unit 100 can be connected with the electronic device 10 in a hot-plug way by pivotally moving the handle 140. Therefore, the fan assembling process can become easy, convenience, and quick.

Continuously referring to FIG. 1 the fan unit 100 further includes a connector bracket 150 for fixing the second connector 130 to make the second connector 130 connect to the first connector 12 smoothly. The connector bracket 150 can connect to the fixture 110 detachably, and has function of easy removing and replacing. The connector bracket 150 can be formed in an L-type structure having a horizontal section 151 and a vertical section 152. The horizontal section 151 is fixed to the fixture 110, and the vertical section 152 is used for fixing to the second connector 130. In particular, a slot 153 is configured in the vertical section 152 to make the second connector 130 fit in the slot 153 tightly. Preferably, a first avoidance space 154 is formed in the connector bracket 150 for accommodating the first wire (not shown in figure) coupled between the second connector 130 and the fan 120. This can restrict the traces space of the first wire, and promotes the comfortability of operation and the esthetics of integral structure. For example, the first avoidance space 154 is a notch. The notch is configured in the horizontal section 151 to make the first wire trace to the vertical section 152 from the horizontal section 151.

In addition, the fan unit 100 usually has a front end and a back end. The front end is close to the user, and the back end is away from the user. Preferably, the second connector 130 is located in the back end of the fan unit 100.

Furthermore, the fan unit 100 further includes a fan indicator light 160 and a indicator light bracket 170. The fan indicator light 160 and the fan 120 are electrically connected with each other, and the indicator light bracket 170 is applied for fixing the fan indicator light 160. The indicator light bracket 170 is formed in a L-type structure having a horizontal section 171 and a vertical section 172. The horizontal section 171 is fixed to the fixture 110, and the vertical section 172 is used for fixing the fan indicator light 160. For example, the fan indicator light 160 is a LED light. A body of the LED light is a cylindrical structure. Correspondingly, the vertical section 172 of the indicator light bracket 170 has a hollow cylinder applied for accommodating the cylindrical structure.

In one preferred embodiment of the present invention, the fan indicator light 160 is disposed in the front end of the fan unit 100 for the user to observe the operating status directly.

Figure 3:
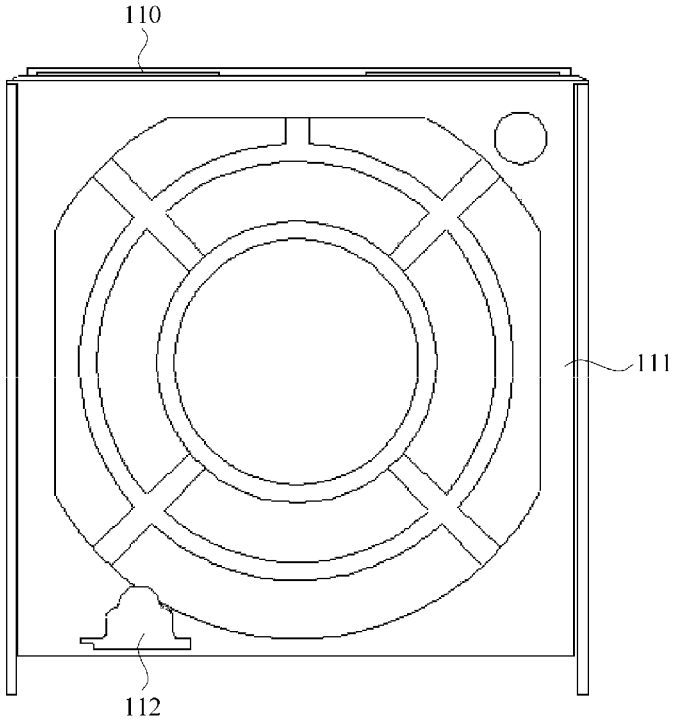
FIG. 3 is a front view illustrating the fixture of the fan unit according to one preferred embodiment of the present invention.

FIG. 3 is a front view illustrating the fixture of the fan unit according to one preferred embodiment of the present invention. Referring to FIG. 3, when the fan indicator light 160 is disposed in the front end of the fan unit 100, a second avoidance space 112 can be formed in a front portion 111 of the fixture 110 (the front end of the fan unit 100) for accommodating a second wire coupled between the fan indicator light 160 and the fan 120. This can simplify wiring means and shorten the trace length, and further ensure the second wire having enough traces space. The second avoidance space 112 is preferably an opening with smooth inner surface, wherein the opening design with smooth inner surface to prevent the second wire from scratching.

Referring to FIG. 1 continuously, the handle 140 includes two pivoting portions 141, 142 and a operating portion 143. The two pivoting portions 141, 142 are bent from two ends of the operating portion 143. The operating portion 143 is forced to drive the two pivoting portions 141, 142 rotate opposite to fixture 110. This is, the operating portion 143 can be forced by the user for driving the handle 140 pivotally moved to the first position or the second position.

In one preferred embodiment of the present invention, the operating portion 143 and two pivoting portions 141, 142 are formed in a U-type structure. The two pivoting portions 141, 142 are pivoted to different sides of the handle 140 respectively. The handle formed in the U-type structure can make the operation of handle become comfortable and easy.

Preferably, when handle 140 is located in the first position (as shown in FIG. 2A), the handle 140 can latch with the fixture 110 automatically to have advantages with positioning accurately, operating conveniently and quickly. The handle 140 is latched with the fixture 110 through engaging connection.

Figure 4:
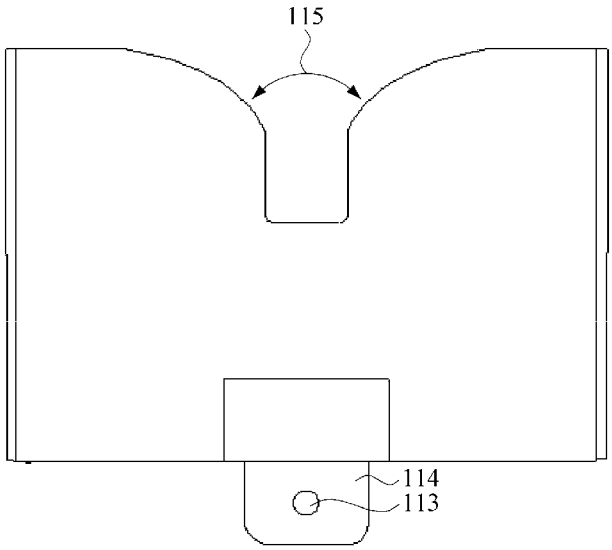
FIG. 4 is a top view illustrating the fixture depicted in FIG. 3.

FIG. 4 is a top view illustrating the fixture depicted in FIG. 3. As shown in FIG. 1, FIG. 2A, FIG. 2C, and FIG. 4, the fixture 110 has an engaging portion 113. Correspondingly, the handle 140 has another engaging portion 144 fit for the engaging portion 113. When the handle 140 is pivotally moved to the first position (FIG. 2A) opposite to fixture 110, the engaging portion 144 is engaged with the engaging portion 113 exactly. Compared to the latching type of plugging connection or screwing connection, the engaging connection of the present invention can achieve the positioning latch of the handle 140, and brings more convenience in operation.

Preferably, the engaging portion 113 is a through hole, and the engaging portion 144 is a flexible bolt. When the handle 140 moves to the first position (as shown in FIG. 2A) pivotally, the flexible bolt is inserted into the through hole exactly to achieve the positioning latch. Due to the flexible bolt be with the function of axial stretching, the flexible bolt can engage into the through hole automatically by the elastic restoring force itself when the handle 140 moves to the first position pivotally. Therefore, the operation is more convenient and quick.

When the flexible bolt and the through hole are engaged with each other, preferably, the fan unit 100 and the electronic device 10 is further fixed directly through the flexible bolt. For example, the fan unit 100 is connected to the electronic device 10 directly through thread structure without the assembling requirement of the fan bracket (the structure for fixing the fan unit 100 on the electronic device 10). This means makes the assemblage of the fan become more simpler, convenient, and reduce the configuration components and costs.

In one preferred embodiment of the present invention, the engaging portion 113 is configured in the top of the fixture 110. When the handle 140 pivotally moves upward to the first position, the engaging portion 144 and the engaging portion 113 are engaged in the top of the fixture 110. An extending portion 114 is formed on the top of the fixture 110. The extending portion 114 is formed by the process of punching and bending the top of the fixture 110, which have the advantage of convenient tooling and low manufacturing cost. Correspondingly, the engaging portion 113 is configured in extending portion 114. For example, a through hole is formed on the extending portion 114 directly to form the engaging portion 113.

Referring to FIG. 4 continuously, a guiding structure 115 is configured on the fixture 110 to make the fan unit 100 move along a guiding direction, and the position of the fan unit 100 can be positioned. People skilled in the art can understand that the guiding direction is the groove direction of the guiding structure 115.The guiding structure 115 is a groove formed in a horn shape. The outer of the groove is configured to be a guiding lead angle (inclination). In particular, the groove is formed on the top of the fixture 110, and the opening of the horn-shaped notch is toward to the back end of the fan unit 100.

Figure 5:
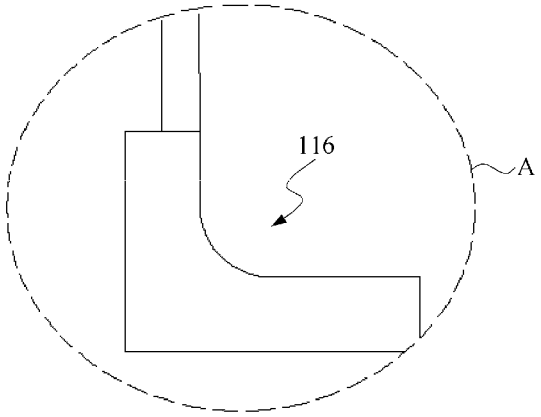
FIG. 5 is a enlarged view of region A illustrating the fan unit depicted in FIG. 1, FIG. 2A, and FIG. 2C.

FIG. 5 is an enlarged view of region A illustrating the fan unit depicted in FIG. 1, FIG. 2A, and FIG. 2C. Referring to FIG. 5, and also referring to FIG. 1, FIG. 2A and FIG. 2C simultaneously, a restriction structure 116 is also formed in the fixture 110. When the handle 140 pivotally moves to the restriction structure 116, the handle 140 is stopped to restrict in the second position (as shown in FIG. 2C). Preferably, the restriction structure 116 is an cutout, and the cutout is formed in the bending line of the fixture 110. For example, when the handle 140 pivotally moves downward to the cutout, the ends of the two pivoting portion 141, 142 withstand the cutout to make the handle 140 stop. Compared to the protruding structure of prior art, taking the cutout formed on the bending line as a stopping structure has advantages of simple structure, convenient tooling, low manufacturing cost.

Figure 6:
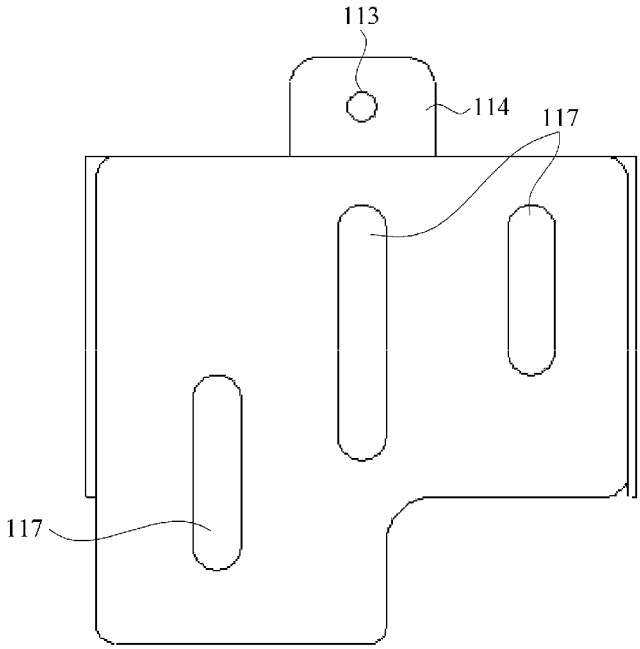
FIG. 6 is a bottom view illustrating the fixture depicted in FIG. 3.

FIG. 6 is a bottom view illustrating the fixture depicted in FIG. 3. As shown in FIG. 6, the bottom of the fixture 110 is formed with a protruding structure 117 which is an outward protrusion. The amount of the protruding structure 117 can be one or more. The configuration of the protruding structure 117 can reduce the friction, and the fan unit 100 can be pushed more easily.

Figure 7:
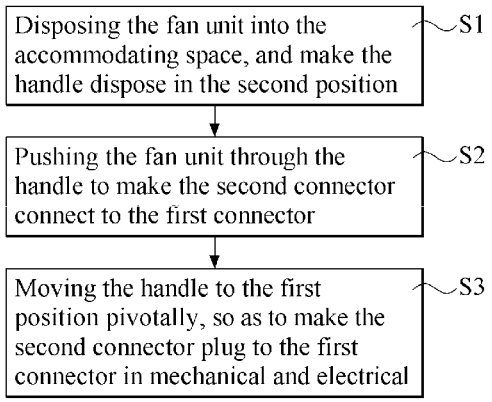
FIG. 7 is a flow chart illustrating the method of assembling a fan unit according to one preferred embodiment of the present invention.

Based on the foregoing fan unit 100, one preferred embodiment of the present invention provides a method for assembling a fan unit 100 in a electronic device 10, as shown in FIG. 7, which is a flow chart illustrating the method of assembling a fan unit according to one preferred embodiment of the present invention. Except for having the first connector 12, the electronic device 10 further has an accommodating space for accommodating the fan unit 100. The method for assembling a fan unit includes the following steps.

Step S1: disposing the fan unit 100 into the accommodating space, and make the handle 140 dispose in the second position;

Step S2: pushing the fan unit 100 through the handle 140 to make the second connector 130 connect to the first connector 12; and Step S3: pivotally moving the handle 140 to the first position, so as to make the second connector 130 plug to the first connector 12 in mechanical and electrical.

It is necessary to be emphasized that when the handle 140 is located in the first position, it is necessary to make an engaging connection between the handle 140 and the fixture 110 act for restricting the handle 140 in the first position. In addition, when the handle 140 is engaged with the fixture 110, preferably, the handle 140 and the electronic device 10 can be fixed with each other for preventing the disconnection caused by the vibration of fan in operation, and have a influence to the normal operation of the fan.

The accommodating space of the electronic device 10 can accommodate one or more fan units 100 for providing better performance in heat dissipating.

Figure 8:
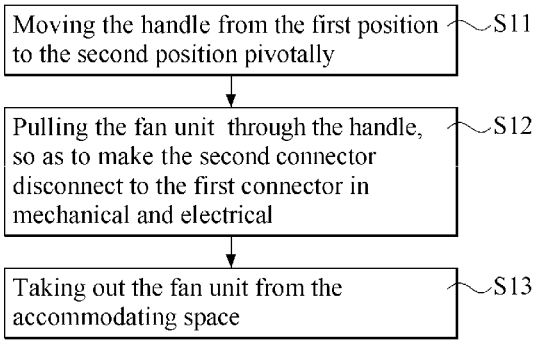
FIG. 8 is a flow chart illustrating the method for removing a fan unit according to one preferred embodiment of the present invention.

Based on the foregoing method for assembling a fan unit, the present invention further provides a method for removing a fan unit as shown in FIG. 8. FIG. 8 is a flow chart illustrating the method for removing a fan unit according to one preferred embodiment of the present invention. In particular, the method for removing a fan unit includes the following steps.

Step S11: pivotally moving the handle 140 from the first position to the second position;

Step S12: pulling the fan unit 100 through the handle 140, so as to make the second connector 130 disconnect to the first connector 12 in mechanical and electrical; and Step S13: Taking out the fan unit 100 from the accommodating space.

Thus, the removing process is simple, and the operation is convenient. Compare to the prior art, the fan unit of the present invention 100 can assemble the fan unit 100 in the electronic device 10 quickly through the handle 140 pivotally connected to fixture 110. Therefore, the assembling process of the fan 120 becomes easy, convenient, and quick. Simultaneously, when the fan unit of the present invention 100 is removed, the fan unit 100 can be removed from the electronic device 10 quickly by pivotally moving the handle 140. Therefore, the removing process is simple, and the operation is convenient.

In addition, in the fan unit 100 of the present invention, pivotal position can be achieved to operate conveniently through the engaging connection between the through hole of the fixture 110 and the flexible bolt of the handle 140. Furthermore, when the handle 140 is located in the first position, the flexible bolt is fixed to the electronic device 10 directly to make the fan unit 100 be assembled into the electronic device 10 independently without assembling the fan bracket. Therefore, when the fan 120 needs to be replaced, it is unnecessary to remove the fan bracket, and make the removing process of the fan 120 become easier. Simultaneously, the manufacturing cost of the electronic device 10 can be reduced.

Furthermore, in the fixture 110 of the present invention, the cutout (restriction structure 116) restricted the handle in the second position is configured in the bending line of the fixture 110. Compare to means of applying a protruding structure for stopping in prior art, the structure of the present invention is more simple, and the manufacturing cost is less.

Furthermore, in the fixture 110 of the present invention, the guiding structure 115 is formed on the fixture 110 to guide the fan unit 100 to move along the guiding direction. The design of the guiding structure makes the assemblage of the fan unit 100 fast and accurately.

Furthermore, in the fixture of the present invention, the second avoidance space accommodated the second wire coupled between the fan indicator light 160 and the fan 120 is configured in front 111 of the fixture 110. This design can expand the assembling space of the second wire to make the assemblage of the fan indicator light 160 become smooth.

While the present invention has been particularly shown and described with reference to a preferred embodiment, it will be understood by those skilled in the art that various changes in form and detail may be without departing from the spirit and scope of the present invention.

What is claimed is:

1. A fan unit adapted for an electronic device having a first connector, and the fan unit comprising:

a fixture;

a fan fixed in the fixture;

a second connector electrically connected to the fan;

a handle pivotally connected to the fixture; and a connector bracket connected detachably to the fixture, having a slot to fit the second connector tightly and detachably;

wherein the handle is operable to be pivotally moved between a first position and a second position opposite to the fixture, when the handle is operated to move to the first position, the fixture is pushed to approach to the first connector by the handle, so as to make the second connector connect to the first connector mechanically and electrically; and when the handle is operated to move to the second position, the fixture is pulled out by the handle, so as to make the second connector disconnect from the first connector mechanically and electrically;

wherein a first avoidance space is formed in the connector bracket for accommodating a first wire coupled between the second connector and the fan;

wherein the connector bracket is formed in an L-type structure having a horizontal section and a vertical section, the horizontal section is fixed to the fixture, and the vertical section is used for fixing to the second connector.

2. The fan unit of claim 1, wherein a through hole is formed on the fixture, a flexible bolt is configured in the handle, when the handle is operated to move to the first position, the flexible bolt is inserted into the through hole and fixed with the electronic device.

3. The fan unit of claim 1, wherein a restriction structure is formed on the fixture, the handle is restricted in the second position when moves to the restriction structure pivotally.

4. The fan unit of claim 3, wherein the restriction structure is a cutout, and the cutout is formed on a bending line of the fixture.

5. The fan unit of claim 1, further comprising:

a fan indicator light disposed in front of the fan unit and electrically connected to the fan;

wherein a second avoidance space is formed in a front portion of the fixture for accommodating a second wire coupled between the fan indicator light and the fan.

6. The fan unit of claim 1, wherein the fixture is configured with a guiding structure formed in a horn shape groove for making the fan unit move along a guiding direction.

7. The fan unit of claim 1, wherein the handle comprises:

an operating portion; and a pivoting portion bent from two ends of the operating portion;

wherein the operating portion is forced to drive the pivoting portion move opposite the fixture pivotally.

8. A method for assembling a fan unit, adapted for assembling the fan unit of claim 1 into an electronic device, the electronic device comprising a first connector and an accommodating space, the accommodating space being applied to accommodate the fan unit, and the method for assembling the fan unit comprising steps of:

(a) disposing the fan unit into the accommodating space, and making the handle dispose in the second position;

(b) pushing the fan unit through the handle to make the second connector connect to the first connector via passing through the slot of the connector bracket which is connected detachably to the fixture; and (c) pivotally moving the handle to the first position, so as to make the second connector plug to the first connector mechanically and electrically.

* * * * *